US006039077A

United States Patent [19]

Schulze

[11] Patent Number: 6,039,077

[45] Date of Patent: Mar. 21, 2000

[54] ELECTROHYDRAULIC CONTROL VALVE ARRANGEMENT

[76] Inventor: Eckehart Schulze, Stahlbühlstrasse 36, D-71287 Weissach, Germany

[21] Appl. No.: 09/043,961

[22] PCT Filed: Sep. 24, 1996

[86] PCT No.: PCT/EP96/04156

§ 371 Date: Mar. 30, 1998

§ 102(e) Date: Mar. 30, 1998

[87] PCT Pub. No.: WO97/13074

PCT Pub. Date: Apr. 10, 1997

[30] Foreign Application Priority Data

Sep. 30, 1995 [DE] Germany ..... 195 36 553

[51] Int. Cl.[7] ..... F15B 13/043

[52] U.S. Cl. ..... 137/625.63; 137/625.64

[58] Field of Search ..... 137/625.63, 625.64

[56] References Cited

U.S. PATENT DOCUMENTS

| | | | |
|---|---|---|---|
| 2,463,931 | 3/1949 | Wyckoff | 137/488 |
| 2,969,808 | 1/1961 | Horlacher | 137/625.63 |
| 3,000,363 | 9/1961 | Hayner et al. | 137/625.64 |
| 3,211,182 | 10/1965 | Gyurik et al. | 137/625.64 X |
| 3,875,849 | 4/1975 | Patel | 137/625.64 X |
| 4,011,891 | 3/1977 | Knutson et al. | 137/625.64 X |
| 4,905,572 | 3/1990 | Devaud et al. . | |
| 5,205,201 | 4/1993 | Gollner . | |
| 5,261,455 | 11/1993 | Takahashi et al. . | |
| 5,329,969 | 7/1994 | Rasmussen et al. . | |
| 5,460,201 | 10/1995 | Borcea et al. | 137/625.65 |

FOREIGN PATENT DOCUMENTS

| | | |
|---|---|---|
| 37 38 241 A1 | 5/1989 | Germany . |
| 195 08 190 A1 | 9/1995 | Germany . |
| 2 037 017 | 7/1980 | United Kingdom . |

OTHER PUBLICATIONS

Johnson, James E.; Primer on Servovalves and Servosystems; In : Hydraulics & Pneumatics, Mar. 1970, S. 106–108; Fig. 1,3,S. 106, re. Sp., Abs. 1.

*Primary Examiner*—Gerald A. Michalsky
*Attorney, Agent, or Firm*—Pendorf & Cutliff

[57] ABSTRACT

The invention concerns an electrohydraulic control valve arrangement (10) for controlling the movement of a hydraulic motor. The control valve arrangement (10) comprises a main control valve (11), which can be actuated by the alternating application and relieving of pressure in two control chambers, and an electohydraulic servo-control valve (14) which operates with electronically controllable piston setpoint input and mechanical actual position data feedback in order to pilot the main control valve accordingly in a manner guided by the setpoint value. The servo-control valve (14) comprises a sleeve-shaped housing element (99) which is disposed so as to be moveable in a pressure-tight manner in a connection block (114) rigidly connected to the housing of the main control valve (11). The servo-control valve (14) further comprises a piston (66) which is likewise disposed so as to be moveable in a pressure-tight manner in the sleeve-shaped housing element and can be driven in alternate directions by means of a controllable electric motor (131) in order to perform incremental deflections with respect to the sleeve-shaped housing element (99) for inputting the position setpoint. The housing element (99) is coupled for movement in a positive and force-locking manner to the piston (16) of the main control valve (11). The servo-control valve (14) is provide with a valve spring arrangement (118, 119) which, in the non-controlled state of the setpoint input motor (131), sets the piston (66) in the setpoint input position associated with the operationally-neutral centre position of the main control valve (11).

14 Claims, 4 Drawing Sheets

ELECTROHYDRAULIC CONTROL VALVE ARRANGEMENT

BACKGROUND OF THE INVENTION

1. Field of the Invention

The invention concerns an electrohyraulic control valve arrangement for controlling the pressure medium input to and discharge from a linear or rotatorial hydraulic motor, with a main control valve constructed as a three position valve, which includes a piston which is displaceable in alternative directions between end positions in a bore of a housing, which correspond to the maximal values of unrestricted or unblocked cross-section of flow-through paths of the main control valve in alternative functional positions I and II, which steadily increase essentially with increasing displacement of the piston out of a (functionally neutral) center position 0, and is correspondingly reduced with a nearing of the piston to its center position, wherein the piston displacement is controllable via an electrohydraulic servo control valve, which is guided by an electrical setpoint value, by the alternating application and relieving of pressure in two control chambers of the main control valve.

2. Description of the Related Art

An electrohydraulic control valve arrangement of this type is the generally known proportional valve ("The Hydraulic Trainer", Vogel-Publishers, Würzburg, 1$^{st}$ Edition 1978, pages 143–145), which in a typical construction includes a main valve constructed as a 4/3-way valve and two pressure regulating valves each of which include via respectively a proportional magnet, which produces an operating force in proportion to electrical strength, controllable pressure regulating valves as servo valve arrangements, via which pressure can be directed to and released from the control chambers of the main control valves.

As a result of its already discussed construction, the known proportional valve is associated with at least the following disadvantages:

On the basis of the always present friction between the magnet anchors and the housing elements of the pressure regulating valve their relationship is associated with a hysteresis, so that a defined value of the energizing current can not always in a predictable manner be associated with a specific opening cross-section of the main control valve. This type of frictional effect brings about a strengthening of the follow or tracking error, or lag, between the setpoint position and actual position of the main control valve piston, as the time interval is reduced, with which the energizing current changes the servo valve, in order to achieve a desired transient response of the respective valve adjustments or positions. Although extreme consequences of such hysteresis-effects can in some respects effectively reduced or avoided thereby, that the time period of the actuating current of the respective controlled proportional magnet is varied, in such a manner, that its temporal middle value corresponds to an effective current strength, which is associated with the desired anchor displacement, which again leads to a servo or pre-control pressure, which should produce a desired positioning of the main control valve piston. The anchor of a servo valve controlled in such a manner is thereby continuously kept in movement, so that the value of the static friction, which is greater in comparison to the sliding friction practically does not come into effect and insofar as the displacement of the controlled anchor continuously under the more favorable or effective secondary condition of sliding friction is possible. Likewise, also with this type of pre-controlling or servo controlling it must be taken into account, that the actual position of the main control valve piston accomplishes only relatively sluggishly the "middle value" of the energizing current of the proportional magnet predetermined setpoint value, since essential agreement of setpoint and actual position can only be achieved after a certain period interval of the periodic energizing or activating current changes, since these are imprinted by superimposing on an alternating current varying between extreme values a direct current which correlates to the setpoint value position to be steered or controlled. For the period duration of the "dither" current utilizable in practice, which acts upon the periodic position change of the servo valve-anchor, of 10 to 20 ms, this means, that-time-wise determined—equilibration of actual and setpoint value the position of the main control valve piston can be achieved only after approximately 1/20 to 1/5 second, which for numerous requirements is too long. This is in particular true then, when the dither-amplitude of the activation current is comparable to the medium value required for adjustment or setting of a pre-determined opening cross-section of through flow-path of the main control valve, that is, in cases in which the main control valve must be operated with relatively small opening cross-sections of its flow through path.

SUMMARY OF THE INVENTION

The task of the invention is thus that of improving a control valve arrangement for the above described type in such a manner, that a virtually completely hysteresis free controlling of the main control valve and also a more sensible control relationship of the overall control valve arrangement is achieved.

This task is inventively solved by the invention.

In accordance therewith there is provided as electrohydraulic servo valve arrangement an electrohydraulic servo control valve, which operates with electro-mechanically controllable position setpoint value advance and mechanical position actual value feedback. For realization of this regulating principal the servo control valve includes a housing element which is disposed so as to be moveable in a pressure-tight manner in a connection block rigidly connected to the housing of the main control valve, as well as a piston element which for its part is moveable in the housing element in a pressure tight manner, wherein one of these two elements serves as a set value setpoint input element, which is drivable by means of a controllable electro-motor in alternative directions for carrying out of incremental deflections with respect to the other element, which is drivable for its part serves as actual position data feedback element, which with the piston of the main control valve is displaceably coupled in a force lock-fitting manner and thereby for carrying out with the deflection movement of the setpoint value input element in corresponding directional manner is drivable in its servo control movement. Further, the servo control valve is provided with a valve spring arrangement, which in the not driven condition of the setpoint input motor, as necessary in certain cases against a still present rest-stop moment of this motor, sets or adjusts or as the case may returns the setpoint value input element to the functional neutral center position of the main control valve associated setpoint value input signal position.

The control valve arrangement according to the invention provides at least the following functional advantageous characteristics, to which elucidation it is assumed, that for the setpoint input signal element of the servo control valve the piston thereof is used, and as actual position data feedback element thereof the piston coaxially surrounding sleeve-shaped housing element is used, wherein the piston is driveable for carrying out incremental deflections with respect to the sleeve-shaped housing element of the servo regulator valve by means of a step motor as setpoint input motor driven rack and pinion drive, which simultaneously functions as a reduction gear, and the sleeve-shaped housing element of the servo regulator valve—without play—is moveably coupled with the piston of the main control valve in such a manner, that its deflections follow those of the setpoint input piston, wherein the sleeve-shaped housing element for its part can be moveably coupled with the piston of the main control valve via a gear, so that with a defined conversion relationship deflections of the main control valve piston can be converted into therewith controlled servo movements of the sleeve-shaped housing element of the servo control valve. In accordance with this function there is accomplished both the servo control valve, independent of changing the sense of the setpoint input and that of the piston position of the main control valve respectively then in its functional neutral middle position, when correspondence of the actual position of the main control valve piston with its setpoint value is given, which via step motor controlled displacement of the setpoint input piston the servo control valve was guided in. Thereby the hysteresis effect of the type described in the introductory portion is practically avoided. The step width of the incremental deflections of the setpoint input piston of the servo control valve is controllable electronically in a simple manner and with respect to its value is predictably setable or pre-determinable in a broad range, so that a sufficient fine stepped, quasi continuously adjustability of the main control valve with regard to the required flow-through cross-section is possible. Problems, which in the known proportional valve result from a "humm" (dither-current)—modulation of magnet energizing current, in principal do not occur in the control valve arrangement according to the invention.

By means of the valve spring arrangement of the servo regulator valve, which returns or resets the setpoint input piston to the neutral center position of the main control valve associated setpoint value-control signal position as soon as a driving thereof by means of a setpoint input signal motor ceases, it is in a simple manner achieved that a hydraulic drive unit controlled via the inventive control valve arrangement ends up in a secure position with the turning off of the setpoint input signal control, even when the driving or operating pressure source remains in operation.

By means of the characteristics or features of alternative embodiments of the control valve arrangement discussed below, in which the respective position feedback element of the servo control valve can be rigidly connected with the piston of the main control valve and in this manner a particularly simple construction of the control valve arrangement is achieved.

Alternatively, however, the main control valve of the control valve arrangement can be constructed as a rotating slide valve and the servo control valve can be constructed as a linear slide valve, in which case a drive unit is provided, which converts the azimuthal displacements of the piston of the main control valve into linear displacements of the feedback element of the servo control valve.

For the control valve arrangement, a constructively simple and preferred embodiment, of which the main control valve is constructed as a linear displacement valve and the servo control valve as a rotating slide valve, of which the actual position data feedback element via a coupling arrangement, which linear displacements of the piston of the main control valve convert into azimuthal displacements of the actual position data feedback element of the servo control valve, with which the main control valve piston is motion coupled, wherein the setpoint input signal element of the servo control valve is connected secure against rotation with the drive shaft of the electrical setpoint input motor, are via the characteristics of advantageous simple embodiments of the coupling device discussed below are given, by means of which the actual position data feedback element of the servo control valve is motion-coupled with the piston of the main control valve. A staying, bracing or fastening assembly envisioned in combination herewith, by means of which the play of the movement coupling between the piston of the main control valve and the actual position data feedback element of the servo control valve is achievable, is realized in a preferred technically simplified and space saving embodiment according to the characteristics of further preferred embodiments.

For the valve spring arrangement which, when the setpoint input signal element of the servo control valve is not in the condition of being controlled the setpoint input signal motor, urges to the functional neutral center position of the main control valve piston associated setpoint input signal position, are the alternatively or in combination utilizable embodiments, which in particular are suitable, when the servo control valve of the control valve arrangement is constructed as a linear slide valve, while via the characteristics of other embodiments a function corresponding or suitable valve spring arrangement is given, which is particularly suitable for the servo control valve of the control valve arrangement constructed as rotating sliding valve.

BRIEF DESCRIPTIONS OF THE DRAWINGS

Further details of the control valve arrangement according to the invention can be found in the following description of two special embodiment examples with respect to the drawings. There are shown:

FIG. 1 a first embodiment of a control valve arrangement which introduces the function of a proportional valve with a main control valve constructed as a linear slide valve and a likewise as linear slide valve constructed servo control valve as servo valve in schematic simplified longitudinal sectional representation;

FIG. 1*a* a hydraulic diagram of connections for explanation of the function of the servo valve arrangement according to FIG. 1;

FIG. 2 a further illustrative embodiment of a control valve arrangement which is the functional analog of the control valve arrangement according to FIG. 1 with a main control valve constructed as a linear slide valve and a servo control valve constructed as rotating slide valve, in a cross-sectional representation according to FIG. 1;

FIG. 2*a* a valve spring arrangement of the servo control valve according to FIG. 2 through which this, in the not driven condition of the setpoint input motor, is found in the indicated configuration, which corresponds to the setpoint input of the neutral central position of the main control valve, partially in section along the Lines IIa—IIa of FIG. 2;

FIG. 2*b* an operating lever spring or spring clip of the valve spring arrangement according to FIG. 2*a* in its tensioned condition, in simplified perspective representation and FIG. 2*c* a section along the Lines IIc—IIc of FIG. 2 for explanation of a free of play movement coupling of the piston of the main control valve with an actual position data feedback element of the servo control valve of the control valve arrangement according to FIG. 2 illustrated bracing device.

DETAILED DESCRIPTION OF THE INVENTION

Figure 1:
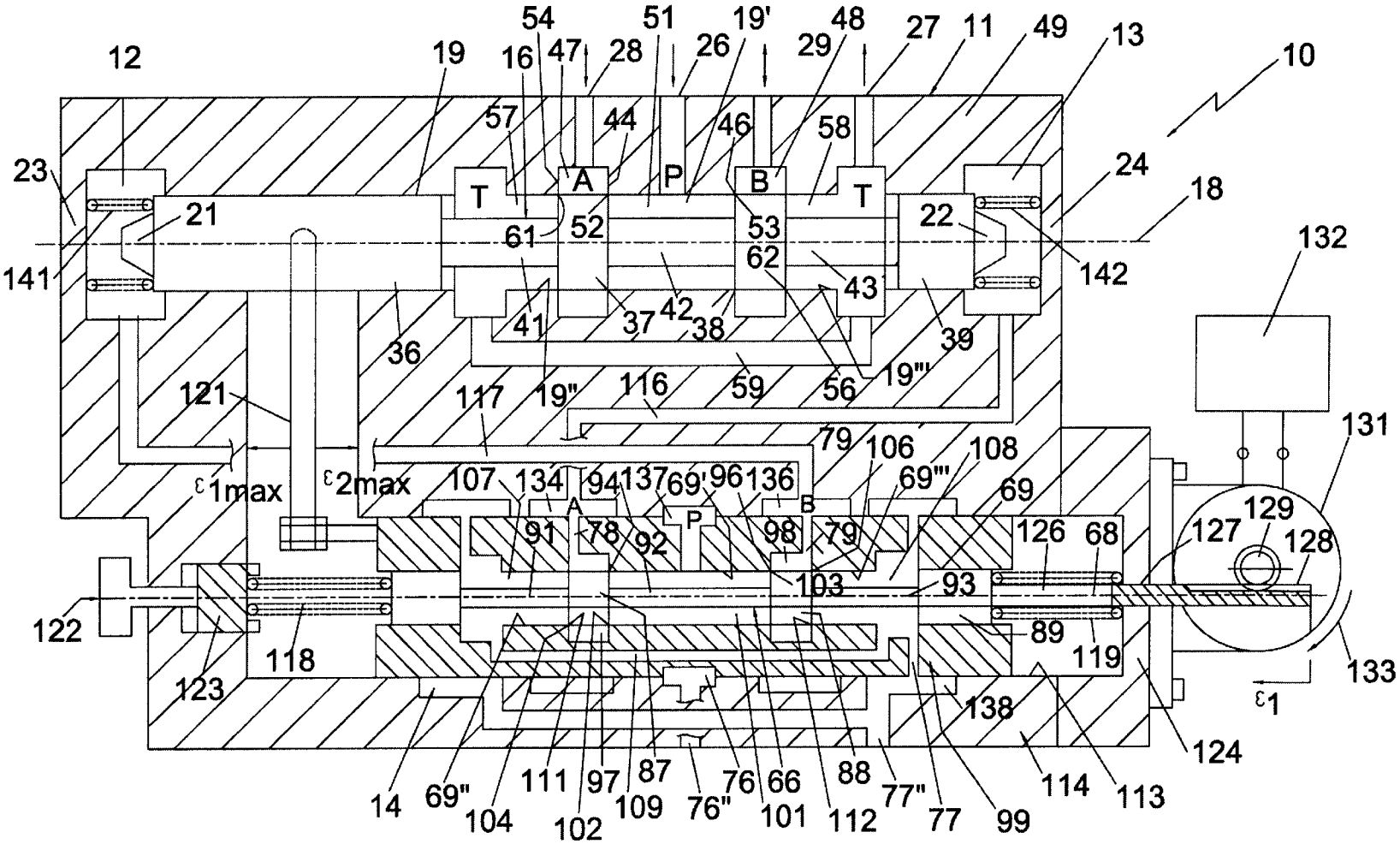

The electrohydraulic control valve arrangement which in FIG. 1 is referenced overall with 10 encompasses a main control valve, indicated overall with 11, which is operable by hydraulic pressure, which is switchable or reversible by alternative application and relieving of pressure in control chambers 12 and 13 from its represented starting position 0 into alternative functional positions I and II, as well as a servo valve and overall with 14 indicated servo control valve, which functions with electrical input signal the set position of the piston 16 of the main control valve 11 and mechanical feedback of the actual position of the piston 16.

Figure 1A:
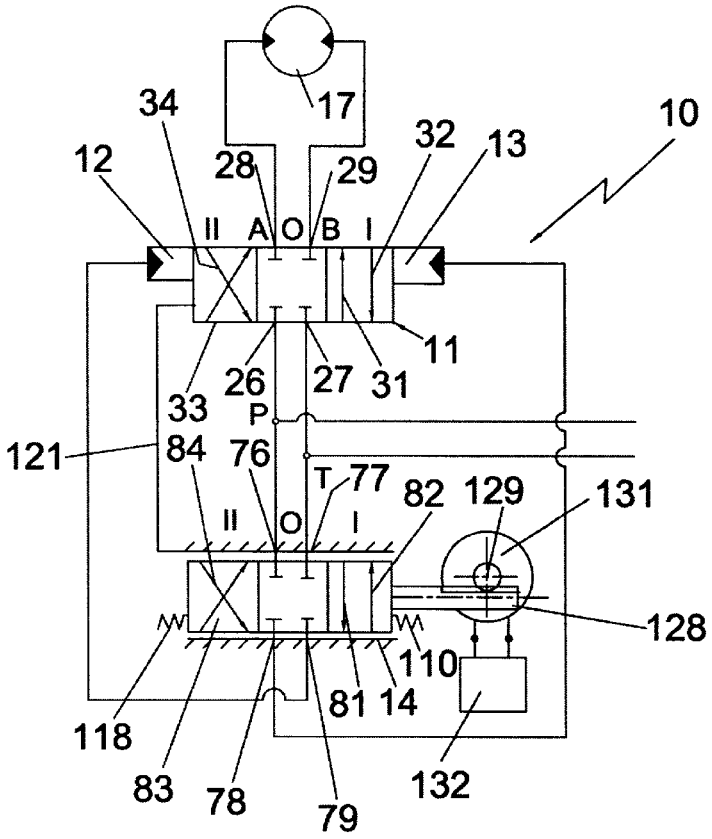

For the purpose of explaining it is assumed that the control valve arrangement 10, as can be seen from the flow diagram or connection schematic of FIG. 1*a*, is employed for the operating control of a rotational hydro-motor 17, of which the alternative rotation directions—clockwise and counterclockwise—are associated with the alternative functional positions I and II of the main control valve 11, wherein the rotational speed of the motor is adjustable by volume of flow of the hydraulic drive medium supplied to and withdrawn from it via the main control valve 11.

The resting condition main control valve 11 as shown with reference number 0 in FIG. 1*a* is associated with the resting condition of the rotational hydro-motor 17.

The main control valve 11 is constructed as a linear slide valve, of which the piston 16 is slidingly displaceable back and forth in the direction of the central longitudinal axis 18 in a housing bore 19 which extends between the control chambers 12 and 13, wherein with respect thereto the end positions are defined by impacting of end pieces 21 and 22 of piston 16 with the respectively oppositely lying wall surfaces 23 or as the case may be 24 of the control chambers 12 and 13.

The main control valve 11 is constructed as a 4/3-way valve, in its shown resting position 0 with the pressure exit of a not shown pressure supply aggregate associated P-supply connection 26 and with the pressureless supply chamber of the pressure supply aggregate associated T-return flow connection 27 as well as against an A-control connection 28 as well also against a B-control connection 29 of the main control valve, which through its alternative application and relieving of pressure accomplishes the drive control of the utilizer 17, is closed off. In the design of the main control valve selected for purposes of explanation this achieves via a through pressure impacting of the according to the representation in FIG. 1 right control chamber 13 and pressure relieving of the left control chamber 12 desired displacements of its piston 16 to the left in its functional position I in which the P-supply connection 26 of the main control valve 11 via a through flow path 31, with an A-control connection 28 and the T-return flow connection 27 via a further flow through path 32 with the B-control connection 29 of the main control valve 11 is connected; by pressure impacting of the left control chamber 12 and pressure relieving of the right control chamber 13 of the main control valve 11 this accomplishes, beginning from the represented starting position 0 in its functional position II, in which via a first through flow path 33 of the P-supply connection 26 is connected with the B-control connection 29 and via a second through flow path 34 of the T-return flow connection 24 of the main control valve 11 with the A-control connection 28 thereof is connected.

The main control valve 11 is constructed as a proportional valve, in which with increasing displacement of its piston 16 away from the rest position 0 corresponding central position, each according to direction of the displacement thereof, which in the alternative functional position I and II released through flow paths 31 and 32 or as the case may be 33 and 34 with increasing larger cross-sections are unrestricted or unblocked, which in the end positions of the piston respectively achieve their maximal value.

For achievement of this function the main control valve 11 is constructed in conventional manner as follows:

The housing bore 19 of the main control valve 11, in which its piston 16 with piston flanges 36, 37, 38 and 39 is pressure tight slideably guided, which flanges are pair-wise rigidly connected with each other through piston rods 41, 42 and 43 of which the cross-section is smaller than that of the housing bore 19, has a central cross-section 19', which extends between housing side control surfaces or edges 44 and 46, which are formed by the bore side edges each other adjacent side walls of control notches 47 and 48 of the valve housing 49, which are respectively in constant communication with the control connections 28 and 29 of the main control valve 11. Their inner bore sections 19' form the radially outer, housing tight bordering of a ring space or cylinder displacement space 51 which stays in constant communication connection with the P-supply connection of the main control valve 11. This cylinder space 51 is axially moveable via the borders of each other adjacent ring end surfaces of the through the middle piston rod 42 with each other connected central piston flanges 37 and 38, which with the outer edges of their each other adjacent or neighboring ring end surfaces on the piston side, form inner control edges 52 and 53, of which axial separation corresponds respectively to those of the inner control edges 44 and 46 of the A-control notch 47 and the B-control notch 48.

The A-control notch 47 and B-control notch 48 of the valve housing 49 enclose via respectively a through the radial inner edge of its axial outer notch flank delineated, outer control edge 54 or as the case may be 56 at bore section 19" or as the case may be 19'", which form housing tight radial borders or edges of cylinder space 57 and 58, which via a housing channel 59 are coupled in communication with each other and likewise coupled to the return flow connection 27 of the main control valve 11.

In the direction of the central longitudinal axis 18 of the housing bore 19 measured thinness breadth of the A-control notch 47 and the B-control notch 48 of the main control valve housing 49 corresponding the axial thickness of the two central piston flanges 37 and 38 of the main control valve piston 16, of which the ring face surfaces facing away from each other with their radial outer edges axially form outer control surfaces 61 and 62, which in the represented rest position 0 of the main control valve 11 likewise are the axial inner control edges 52 and 53 of the inner piston flange 37 and 38 in null overlap with the housing side control edge 54 and 56 or as the case may be 44 and 46, so that in this rest position 0 both of the pressure supply aggregate constantly communication connected ring spaces 57 and 58 are closed off from the pressureless supply chamber against the housing side control notch 47 and these from their side against the central, with the P-supply connection 26 communicating connected ring space 51 of the main control valve.

The pressureless supply chambers of the supply aggregate connected with T-ring space 57 and 58 are pressure tight moveably sealed off by the end flange 36 and 39 of the piston 16 of the main control valve 11 against the control chamber 12 and 13 thereof.

If in the, according to the representation in FIG. 1, right control chamber 13 pressure is supplied and in the left control chamber 12 pressure is released, whereby the piston 16 of the main control valve 11 experiences a displacement towards the left, then the main control valve comes to be in one of the functional position I corresponding arrangements of the piston side and the housing side control edges, that is, the A-control notch 47 in communicating connection with the ring space 51 under high pressure and the B-control notch 48 in communicating connection with the right T-ring space 56.

By the pressure impacting of the left control chamber 12 and relieving of the right control chamber 13 the main control valve 11 is moved to its functional position II, in which the A-control notch 47 is in communicating connection with the left T-ring space 57 and the B-control notch 48 with the central T-ring space 51.

The amount or value of the in the alternative through flow position I and II derestricted cross-section of the flow through path 31 and 32 or as the case may be 33 and 34 of the main control valve 11 is adjustable by means of the servo control valve 14, by means of which the pressure impacting and releasing of the control chambers 12 and 13 of the main control valve 11 are controllable. The servo control valve 14 is constructed in the here represented, special embodiment in substantial construction analogy to the main control valve 11 as linear slide valve, which is provided with parallel a progress or flow of the central longitudinal axis 68 the central longitudinal axis 18 of the main control valve 11. Also, the servo control valve 14 repeats the function of or serves as a 4/3-way valve, for which in overall with 66 represented piston and its housing 99, apart from the cross-sectional measurement of a larger axial spacing apart of the central piston flanges 87 and 88, extends between with the T-ring space 101 of the servo control valve 14, providing with the same configuration of piston side control edge or surface 102, 103, 111 and 112 as well as housing side control edge 94, 96, 104 and 106, as in the main control valve 11. The same holds in the sense for all this type of element of the servo control valve 14, which in FIG. 1 as well as la is filled in with reference numbers, which in comparison to the respective reference numbers, with which the already described construction and functional elements of the main control valve 11 are occupied, are increased by 50, so that with respect to the description of the with the increased reference number provided elements of the servo control valve 14 reference can be made upon the description of the main control valve 11, in order to avoid unnecessary repetition.

The housing 99 of the servo control valve 14 is formed with an outer cylindrical housing, with a central longitudinal axis 68 of the servo control valve 14 co-axial bore 113 of a housing block 114, which is connected rigidly with the housing 49 of the main control valve 11, pressure-tight sliding back and forth is displaceably guided.

The A-control connection 78 is connected with the control chamber 13 of the main control valve according to FIG. 1, while the B-control connection 79 of the servo control valve 14 is connected with the left control chamber 12 of the main control valve 11. The appropriate connecting channels are referenced with numbers 116 or as the case may be 117.

The piston 66 of the servo control valve 14 has a middle position centered by valve springs 118 and 119, which is the setpoint input signal position for the there represented starting position of the piston 16 of the main control valve 11, which via a schematic indicated bridge 121 is connected against movement with the housing 99 of the servo control valve 14.

This assignment of the rest or starting position 0 of the servo control valve 14 and the main control valve 11 is achieved by the precision of the construction as well as in certain cases the adjustability of the mechanical connection between the main control valve piston 16 and the piston 66 of the servo control valve 14 as well as the adjustability of the rest position of the valve piston 66 of the servo control valve 14. With respect thereto adjustability of the piston position is indicated in FIG. 1 by a position set screw 122, by means of which the support block 123, on which the one valve spring 118 on the housing side is supported, is axially displaceable, while the other valve spring 119 axially supports on the oppositely lying wall face 124 the housing block 114 containing servo control valve 14.

The piston 66 is on its one, according to FIG. 1 right end with a slender, rod-shaped, right valve spring 119 centrally through-going extension 126 provided, which extends through a central bore 127 of the end surface wall 124 and at its free end is constructed as a rack 128, of which the teeth are in engagement with the drive pinion 129 of an electric step motor 131 in a free of play combing engagement.

The step motor 131 is by output impulses of an electronic control unit 132 controllable for carrying out incremental rotational movements in the possible alternative rotational directions.

By a controlling or driving of the step motor 131 in the arrow 133 represented rotational direction (+) $\phi_1$ the valve piston 166 of the servo supply valve 114 experiences, with respect to the represented starting position 0 a deflection $\epsilon_1$, correlated with this angular amount $\phi_1$, in accordance with the representation of FIG. 1 to the left, whereby the functional position I of the servo control valve corresponding configuration its valve piston 66 and its sleeve-shaped housing element 99 is achieved, with the consequence, that via the A-control connection 78 the servo control valve 14 changes pressure in the right control chamber 13 of the main control valve 11 and the left control chamber 12 thereof via the B-control connection 79 of the servo control valve 14 is relieved of pressure. The main control valve piston 16 and the with this fixed against displacement connected, sleeve-shaped valve housing element 99 of the servo control valve 14 experienced thereby likewise a deflection "to the left" following the deflection $\epsilon_1$ of the piston 66 of the servo control valve 14, which comes to rest, as soon as the piston 66 and the sleeve-shaped housing element 99 of the servo control valve 14 again in the represented end position 0 corresponding configuration coincide, that is, the main control valve piston 16 has carried out the same deflection $\epsilon_1$ to achieving the function position I of the main control valve 11 as the piston 66 of the servo control valve, which via the electric input control signal has correspondingly displaced the setpoint value.

In an analogous manner the main control valve 11 is in its functional position II controllable and on defined value the opening cross-section of the in this functional position II made free flow through path 33 and 34 is adjustable.

The A-control coupling 78 and the B-control connection 79 of the servo control valve 14 as well as its P-supply connection 76 and its T-flow back connection 77 mouth or connect within flat or shallow ring notches 134 and 136 or as the case may be 137 and 138 of the housing block 114, which are in communicating connection with the A-connection channel 116 and the B-connection channel 117 or as the case may be the P-supply connection 76" and the T-return flow connection 77' of the immovable housing block 114 and in axial direction "on both sides" of the in starting position 0 of the main control valve 11 associated middle position of the sleeve-shaped housing element 99 of the servo control valve are so far displaced, that their respective coupling connections with the valve spaces 101, 107 and 108 in various possible displacement positions of the housing 99 is achieved. In a typical arrangement of the control valve arrangement 10 the maximal deflections $\epsilon_{1max}$ and $\epsilon_{2max}$ of the piston 66 of the servo control valve 14 out of its spring centered middle position, with which also appropriate maximal deflections of the main control valve piston 16 and the with this fixedly connected servo control valve housing 99 is coupled, respectively 90° rotations of the drive pinion 129 of the step motor 131 in clockwise direction and in counterclockwise direction, wherein this 90° rotation, controlled by the electric control unit 132 is divided into respectively 100 incremental steps of equal amount. The herewith coupled stepability of the opening cross-section of the main control valve 11 in its both functional positions I and II corresponds practically a continuous variability of the opening cross-section of the respective flow through path.

The valve springs 118 and 119 which engage the as setpoint value servo element employed valve piston 66 of the servo control valve 14 are so positioned or adjusted, that they in the not energized condition of the step motor 131 are in condition, to overpower the rest detaining movement thereof and to bring the valve piston 66 in the neutral middle position thereof, with a consequence, that, as long as pressure supply is in condition, also to bring the main control valve back to its resting position 0. In order to achieve this position of the main control valve piston 16 also in lost pressure supply, it is effective or useful, when also the rest position 0 of the main control valve piston 16 and with this respectively the valve housing 99 of the servo control valve 14 via valve springs 141 and 142 of the main control valve 111, which can be significantly weaker constructed than the valve springs 118 and 119 of the servo control valve 114, to center by the springs.

Figure 2A:
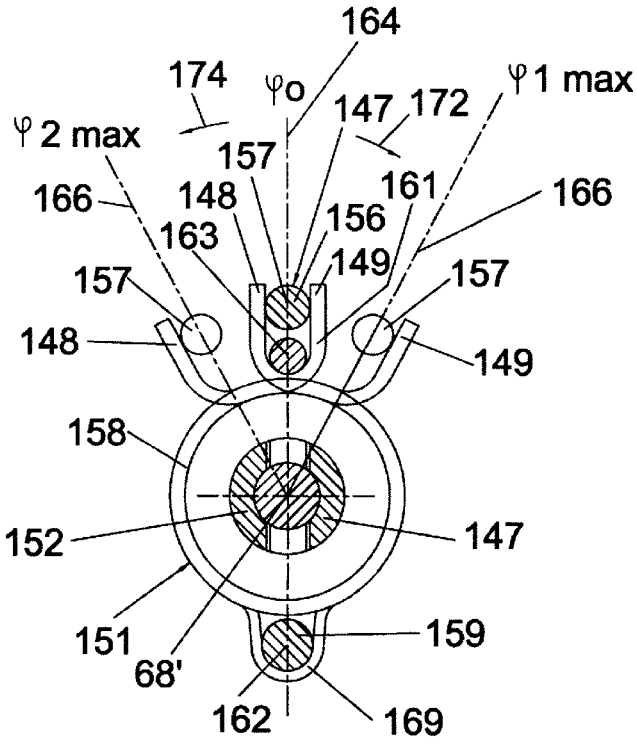
Figure 2B:
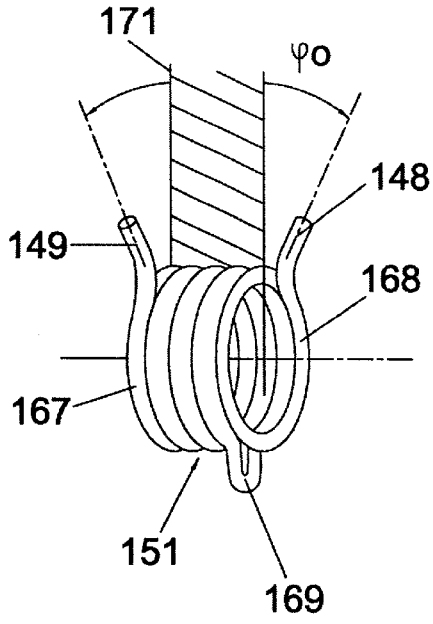
Figure 2:
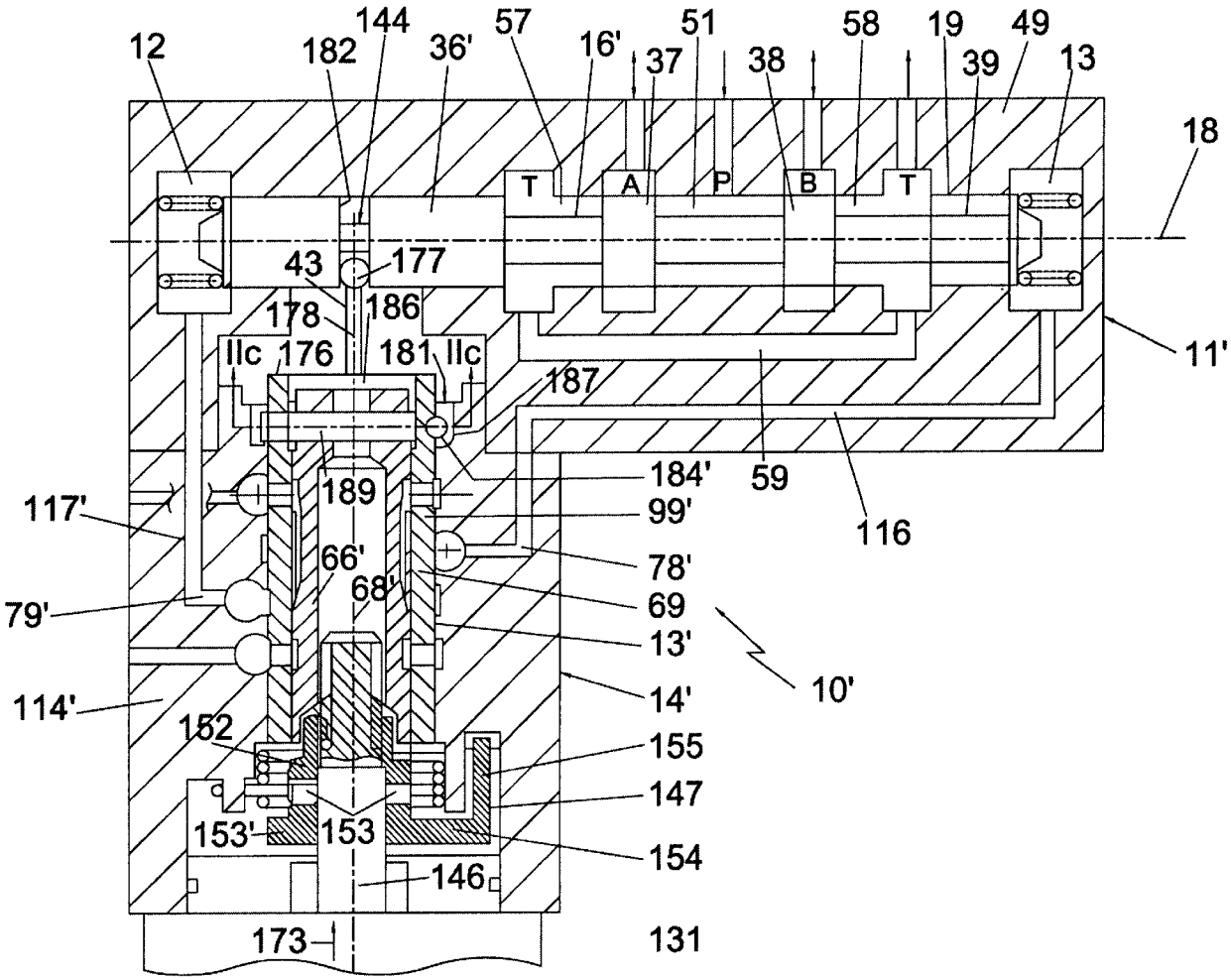

The in FIG. 2, in which individual details can now be omitted, as further embodiment represented, in general with 10' indicated control valve arrangement is functionally in large part analogous to control valve arrangement 10 according to FIG. 1 and differs from it essentially only in the construction or design of the servo control valve 14' as rotating sliding valve and the hereby necessary construction of the piston 16' of the main control valve 11' which communications or transmits the movement coupling of the same with the position—actual value—feedback element 99' of the servo control valve 14'.

Insofar as for elements of FIG. 2 the same reference numbers are given as the already in FIG. 1 described elements, reference should be made to the description given with respect to FIG. 1. By the utilization of reference numbers, which are provided with a (') , with respect to their number however are identical with reference numbers found in FIG. 1 described construction and functional elements of the control valve arrangement 10, reference should be made to their construction and/or functional analogy.

In the servo control valve 14' of the control valve arrangement 10' according to FIG. 2 there is achieved the setting or controlling of the setpoint value of the position of the piston 16' of the main control valve 11' by rotating its central piston 66' about the central longitudinal axis 68' of the servo control valve 14, which with a to the central longitudinal axis 18 of the main control valve 11' right angularly flow of its central longitudinal axis 68' to the main control valve 11' is connected or associated. The return signal of the actual value of the position of the piston 16' of the main control valve 11' is achieved or accomplished by the "rotating with" of the basically or basic construction according to cylindrical sleeve-shaped housing element 99' of the servo control valve 14' about the central longitudinal axis 68' thereof, wherein the conversion of translational movement of the main control valve piston 16' along the central longitudinal axis 18 thereof in rotatoric movement thereof as return signal element used housing part 99' of the servo control valve 14' by form fitting engagement of a with this sleeve or casing shaped rotatable housing part 99 of the servo control valve 14' fixedly connected coupling element 143 with a ring notch 144 of the main control valve piston 16' comes to assemble or to the condition, that in the middle area or realm the relative longitudinal extending of the piston flange 36' is associated, which forms for the one part the pressure tight moveable boundary of the left control chamber 12 and for the other part also the one-left-pressure tight moveable boundary of the left T-ring space 57 of the main control valve 11'.

The piston 66' of the servo control valve 114 serving as setpoint value servo element is fixedly connected with the drive shaft 146 of the step motor 131 which via an outer straight gear teething with an inner straight gear teething of the piston 66' with this is in free of play combing engagement.

The setpoint value servo piston 66' of the servo control valve 14', which is pressure tight rotatably guided in the central through-going bore 69' of the sleeve-shaped housing element 99', which for its part is pressure tight rotatably guided in the connection lock 114' of the servo control valve 14' central through-going bore 113' of the connection block 114 of the servo control valve 14' about its central longitudinal axis 68', is rotatably connected with an overall with 147 indicated back square, which between free shank ends 148 and 149 (FIG. 2*a* and FIG. 2*b*) an overall with 151 indicated shank spring extends into, which is under an azimuthal pre-tensioning, via which the free shank ends against each other directed azimuthal forces are directed and against each other facing away from each other contact surfaces or impinging surfaces of the back square 147 are urged. The shank spring 151 is detained against a rotating about the central longitudinal axis 168' and communicates thereby, both by its pre-tensioning, which is sufficient, in order in a electrically de-energized condition of the step motor 131 from this still present arresting moment to overpower the effect, that the setpoint input piston 66' in the de-energized condition of the step motor 131 returns to the in the FIG. 2 and 2*a* represented, defined azimuthal position $\phi_0$, which in the represented, neutral middle position 0 of the main control valve 11' is associated as setpoint input signal position.

The return arrangement 147 formed of the shank spring 151 and the back square 147, functionally the valve spring 118 and 119 of the "linear" servo control valve 114 according to FIG. 1, corresponding return assembly 147, 151 of the rotating sliding-servo control valve 14' according to FIG. 2 is in greater detail realized as follows:

The back square 147 includes or encompasses a stable, a section of the driven shaft 146 of the step motor 131 coaxially encompassing fixing casing 152, which on its valve side end is provided with an inner straight teething or gearing, which is in combing or inner digitating engagement with a short section of the outer straight teeth or gears of the drive shaft 146 of the step motor 131 and thereby is connected fixed against rotation with this drive shaft 146. The fixing casing 152 is secured against rotation against axial slippage with respect to the drive shaft 146 via grub or headless screws 153. From the motor side, flange shaped edge 153' of the fixing casing 152 of the back square 147 there extends a radial flat rod shaped shank 154, on the radial outer end of which and with a to the radial shank 154 right angled towards the valve end directed path of a round rod shaped back bore impact shank 156 engages the impact angle or back square, wherein the central axis 157 of this impact shank 156 runs parallel to the central longitudinal axis 68' of the servo control valve 114.

The shank spring 151 has with the central axis 68' of the servo control valve 14 coaxial windings 158 of like internal cross-section, which in the represented, special embodiment is the same as the cross-section of the bore 113' of the attachment or coupling block 114' of the servo control valve 14'.

Radially outside of the from the windings 158 of the shank spring 151 enclosed cylindrical area there are in respect to the central longitudinal axis 68' of the servo control valve diametric arrangement an anchor plug or projection 159 and an impact plug 161 with circular round cross-section provided, which both from one of the 131 motor or as the case may be impact angle or back square 147 facing side the attachment block 114' of the servo control valve 14' are spaced. The central longitudinal axis 162 of the anchor plug and the central longitudinal axis 163 of the abutment plug 161 run parallel to the central longitudinal axis 68' of the servo control valve 14', wherein via the central longitudinal axis 163 of the abutment plug 161 and the central longitudinal axis 68' of the servo control valve 14 a "central" radial plane 164 is defined, in which also the central longitudinal axis 157 of the abutment shank 156 of the abutment angle or back square 147 extends, as well as also the radial middle plane 166 thereof, when the central piston 166' of the servo control valve 14 is situated in its central or base position 0 of the main control valve 11 arranged setpoint input position.

The shank spring 151 has, as can also been seen from the detailed representation in FIG. 2*b*, in the illustrative embodiment represented for explanation, four "inner" closed to themselves windings 158, which run in radial separation from the fixing casing 152 of the back square 147 and this respectively with the full circumference angle of 360° enclose, as well as on each end face side of the shank spring an end-winding 167 or as the case may be 168, which, with respect to the housing or casing attached, via the central longitudinal axis 68' and 163 of the servo control valve 14' or as the case may be the abutment plug 161 marked radial plane 164 of the orientation $\phi_0$ only over a part of the circumference of the inner windings 158 extending. On these end side partial windings 167 and 168 are attached or locked on, as can best be seen in FIG. 2*a*, with flat bending, which corresponds approximately to that of the abutment tap 161, which radially or approximately radially extending free shank end 148 and 149 of the shank spring 151.

One of the central windings, which between two "complete", the fixing casing fully enclosing windings 158 is positioned, is within an azimuthal angular area of in total of approximately 60° provided with a U-shaped radial bulge 169, through which the anchor plug or tap 159, which the abutment plug 161 diametrically oppositely is oriented, from the outside form fittingly engages about is provided the shank spring 151 in the arrangement shown in FIG. 2*a* is ensured against a rotation about the central longitudinal axis 68' of the servo control valve 14'.

In the FIG. 2*b* represented tensioned condition of the shank spring 151 corresponding configuration the partial winding 167 and 168 extended only over a—upon the between the free shank ends 148 and 149 extending longitudinal plane 171 with respect to—circumference area of approximately 160°, so that between their free shank ends 148 and 149 a "thinner" azimuthal separation of approximately 40° remains, that is, a positive overlapping of the end position partial windings 167 and 168 in circumference direction is not given.

In order to provide necessary azimuthal pretensioning for the operating function of the shank spring 151, namely in the de-energized condition of the step motor 131 to rotate the setpoint input piston 66' of the servo control valve 14' in that orientation, which is associated with the base position 0 of the main control valve 11', the shank spring 151 is sent, that this during the assembly in the broken lines shown configuration in FIG. 2*a* is brought, in which the outer, end terminal partial windings 167 and 168, radial within the abutment plug 161 on these passing by on one through these cross-section dependent circumscribing overlapping and with radial extending free shank ends 148 and 149 themselves respectively on each other facing away from each other sides of the abutment plug 161 on this—azimuthal—supporting.

After this configuration of the shank spring 151 is set and the base position 0 of the main control valve 11' corresponding position of its piston 16 as well as the therewith associated piston of the return signal element 99' of the servo control valve 14 and also with the base position 0 of the servo control valve 14' associated azimuthal position of its setpoint input piston 16' is set or dialed in, which can be accomplished without requiring special instructions, the step motor 131 with that orientation of its back square 147 is so seated, in which the abutment shank 156 of the back square 147 radial outside of the abutment plug 161 between the free shank ends 148 and 149 of the partial windings 167 and 168 engages and in this position on the housing block 114' of the servo control valve 14 is secured, whereby the radial orientation $\phi_0$ of the radial plane 164 of the back square 147, which with the drive shaft of the step motor 131 is fixed against rotation, the base rotation 0 of the servo control valve 14 and therewith also the main control valve 11 is properly functionally associated.

The servo control valve 14 is so constructed, that it via a by means of the step motor 131 controlled rotation of its central valve piston 66' in the direction of the arrow 172 of the FIG. 2*a*, that is, seen in the direction of the arrow 173 in FIG. 2, in rotational sense in its functional position I standing, in which the right control chamber 13 of the main control valve 11' via the A-control connection 78' of the servo control valve 14' is placed under pressure and the left control chamber 12 of the main control valve 11 via the B-control connection 79' of the servo control valve 14 is relieved of pressure, with a consequence, that also the main control valve 11 with an azimuthal deflection of the central piston 66 of the servo control valve 14 associated axial deflection with respect to the base position of its valve piston 16' in the functional position I is steered. In an analogous manner the main control valve 11' is through step motor controlled azimuthal rotation of the central piston 66' of the servo control valve 14' controllable in the direction of the arrow 174 in FIG. 2*a* in its functional position II, in which its valve piston 16', with respect to its neutral central position 0, experiences a deflection "towards right" which with the azimuthal deflection of the central servo control valve piston 66' is monotonically correlated.

The main control valve 11' and the servo control valve 14' of the control valve arrangement 10' according to FIG. 2 is configured with respect to each other that the maximal deflections $\epsilon_{1max}$ and $\epsilon_{2max}$ of the piston 16' of the main control valve 11' in the sense of its input the functional position I or II azimuthal deflection $\phi_{1max}$ or $\phi_{2max}$ of the piston 66' in the direction of the arrow 172 or as the case may be 174 of FIG. 2*a* correspond, which respectively have a value of 30°, which in FIG. 2*a* through azimuthal orientation $\phi_{1max}$ and $\phi_{2max}$ of the radial central plane 166 of the back square 147 of the servo control valve 14' represents.

The for translatorial conversion, in the direction of the central longitudinal axis 18 of the main control valve 11' resulting movement of the piston 16' in rotatoric "feedback" movement of the sleeve-shaped feedback housing element 99' of the servo control valve 14' provided coupling element 143, there is formed as a slender, from the circular ring shaped face edge 176 of the sleeve-shaped feedback housing element 99' of the servo control valve 14' extending, on its end with a ball shaped head 177 provided staff 178, of which the central longitudinal axis 179 runs parallel to the central longitudinal axis 68' of the servo control valve. The diameter of the ball shaped head 177 of the coupling element 143 corresponds, aside from a reduction of a few hundredths of millimeters with the thinner breadth of the ring notch 144 of piston 16', into which the coupling element 143 radially or approximately radially extends. The thickness of the staff shaped part 178 of the coupling element 143 is smaller than the cross section of its ball shaped head 177. The radial separation r of the central longitudinal axis 179 of the coupling element 143 from the central longitudinal axis 68' of the servo control valve 14', which cumulatively must be satisfied with the relationship $$r \geqq \epsilon_{max}/\sin(\phi_{max})$$

when valid, that $\epsilon_{max}=\epsilon_{1max}=\epsilon_{2max}$ and likewise $\phi_{max}=\phi_{1max}=\phi_{2max}$, has in this for illustration selected example the value $r=2\ \epsilon_{max}$.

The radial separation $r_{max}$, in which the central longitudinal axis 68 of the servo control valve 14' runs from the central longitudinal axis 18 of the main control valve is given by the equation $$r_m = r - \left(\sqrt{r^2 - \varepsilon_{\max}{}^2}\right) / 2$$

In this arrangement of the servo control valve 14' and the main control valve 11' to each other, the values about which the ball shaped head 77 of the coupling element 143 with respect to the central longitudinal axis 18 of the main control valve 11' represent, parallel to the central longitudinal axis 68' of the servo control valve 14' extending longitudinal central plan of the piston 16' of the main control valve 11' in alternative directions—"towards up or down" can be deflected, each being equal, so that in each azimuthal position of the sleeve-shaped housing element 99' of the servo control valve 14' an approximately central positioning of the ball shaped head of the coupling element 143 in the ring notch 144 of the piston 16' of the main control valve 11' results.

Figure 2C:
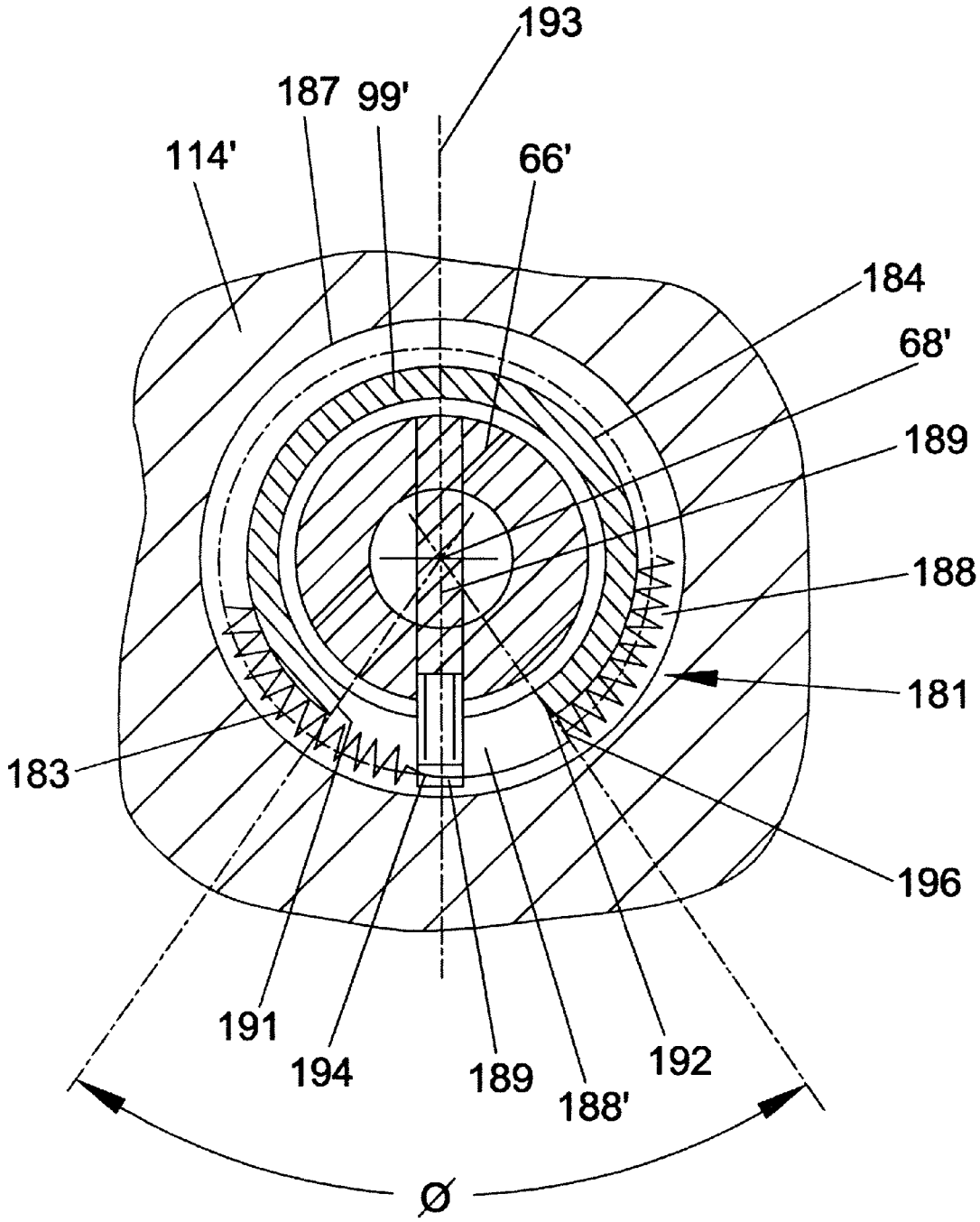

In order to achieve for a precise function of the control valve arrangement 10' suitable freedom from play of the movement coupling between piston 16' of the main control valve 11' and the sleeve-shaped housing element 99' of the servo control valve 14', there is provided a, functioning as a torsion spring, shown generally with 181, tension device, which exercises azimuthal supported torque, upon the sleeve-shaped housing element 99' of the servo control valve 14' a to the central piston 66', which fixed against rotation with the drive shaft 146 of the step motor 131 is connected, on the basis of which the head 177 of the with the sleeve-shaped housing element 99' fixed against rotation is connected to coupling element 143 dependably is held in abutment with the single notch wall 182 of the ring notch 144 of the piston 16' of the main control valve 11'. This tensioning device 181 for which discussion or illustration reference can also be made to FIG. 2*c* encompasses an outer helical spring 183 standing under pull pre-tension, which upon an azimuthal area, which approximately is smaller than the to the total pivot area $\phi_{1max}-\phi_{2max}$ of the sleeve-shaped housing element 99' of the servo control valve 14 to 3600 complimentary angle, from an outer, concave ridge 184 of an axial direction only slightly escavated, from the central bore 113' of the connection block 114' of the main control valve 11' projecting end section 186 (FIG. 2) of the sleeve-shaped housing element 99' is received. The bending radius of this ridge 184 is slightly larger than that of the spring coils, which with the radial inner 180° area of this concave ridge 184 are received and on its ground are supported. The short end section 186 of the sleeve-shaped housing element 99 of the servo control valve 14 serving as mechanical feedback element extends through an opposite to the central bore 113' of the housing block 114 of the servo control valve 14' in which the sleeve-shaped housing element 99' in segments of its length pressure tight sliding is rotatably provided, further bore steps 187, of which the cross-section is slightly larger than the outer diameter of the helicoil spring 183 wherein the radial thinness width of the between the bore steps 187 and the outer coating or jacket surface of the coil spring 183 carrying end section 186 of the sleeve-shaped housing element 99' remaining ring cleft 188 is smaller than the cross-section or diameter of the individual spring coils, which have a spring wire thickness of 0.2 mm to approximately 2 mm. Thereby the coil spring 183 is against an axial pushing out of the ring cleft 188 sufficiently secured. In the central valve piston 66' there is therein from the end section 186 of the sleeve-shaped housing element 99' on the azimuthal area of approximately 300° co-axial encompassed, out of the central bore 113' of the connection block 114' to the main control valve 11' extending area an abutment rod 189 securely seated, which on one side radially extends into the "free" ring cleft area 188', this azimuthal width through the azimuthal separation radial end face surface 191 and 192 is determined, which itself in axial direction over the depth—axial gap—of the coil spring 183 carrying end section 186 of the sleeve-shaped housing element 99' of the servo control valve 14' extending.

The design of the sleeve-shaped housing element 99' of the servo control valve 14', and the orientation of the rigidly with the setpoint input piston 66' of the servo control valve 14' connected abutment rod 189, is so determined based upon the other, that in the equilibrium of position—setpoint value and position—actual value of the piston 16' the main control valve 11' corresponding middle position 0 of the servo control valve 14' which the central longitudinal axis 193 of the abutment shaft 189 and the central longitudinal axis 68' of the servo control valve 14' corresponding radial plan of the angle Ø cuts in half, since the radial end face surfaces 191 and 192 of the coil spring 183 carrying end section 186 of the sleeve-shaped housing element 99' engage lockingly with each other. This angle Ø is selected to be sufficiently large, that the central piston 66', which respect to the represented middle position of the abutment shaft or rod 199 about the maximal deflection angle $\phi_{1max}$ and $\phi_{2max}$ in clockwise and in counterclockwise sense with respect to the sleeve-shaped housing element 99' is rotatable, without that this free-of-play engagement with the piston 16' of the main control valve 11' is lost.

The one end 194 of the coil spring 183 is secured on the free end section 189' of the abutment shaft 189, while the other end 196 in close proximity to the radial face 192, on which sleeve-shaped housing element 99' is secured, of which azimuthal spacing from the abutment rod 189, seen from the path direction of the spring 183 corresponds approximately to the azimuthal alignment or orientation.

What is claim is:

1. Electrohydraulic control valve arrangement for controlling the pressure media supply to and discharge from a hydraulic motor, including:

a main control valve constructed as a 3-position-valve, which main control valve includes a piston which is displaceable in alternative directions between end positions in a bore of a housing, which end positions correspond to the maximal values of derestricted cross-section of flow-through paths of the main control valve in alternative functional positions I and II, which steadily increase essentially with increasing displacement of the piston out of a functionally neutral center position 0, and is correspondingly reduced with a nearing of the piston to its center position, and an electrohydraulic servo control valve which is guided by an electronic setpoint value, and which controls said main control valve piston displacement by the alternating application and relieving of pressure in two control chambers of the main control valve, wherein a) as the electrohydraulic servo control arrangement an electrohydraulic follow-up servo control valve (14; 14') is provided, which operates with electromechanically controllable position setpoint input and mechanical actual position data feedback in order to pilot the main control valve in a manner guided by the setpoint value, and is constructed as a 4/3 way valve which has a P-supply connection (76), which is in communication with the pressure outlet of a pressure supply unit, as well as a T-return connection (77), which is connected with an unpressurized reservoir of the pressure supply unit, and which further has an A-control connection (78), which is in communication with one of said control chambers (13) of the main control valve (11), and further has as a B-control connection (79), which is in communication with the other of said control chambers (13) of the main control valve (11), wherein in one of the central positions of the main control valve (11) associated central positions of the piston element (66; 66') of the follow-up servo control valve (14; 14') the supply and the user connections are closed off against each other, and in the alternative functional positions I and II in which the follow-up servo control valve (14; 14') is positioned as a function of the given setpoint value, on the one hand the A-control connection (78) is in communication with the P-supply connection (76) and the B-control connection (79) is in communication with the T-return flow connection (77), and on the other hand the A-control connection (78) of the follow-up servo control valve (14; 14') is in communication with its return flow connection (77) and the B-control connection (79) is in communication with the P-supply connection (76) of the follow-up servo control valve (14; 14');

b) the servo control valve (14; 14') comprises a sleeve-shaped housing element (99; 99') which is disposed to be moveable in a pressure tight manner in a connection block (114, 114') rigidly connected to the housing of the main control valve (11, 11'), and a piston element (66; 66') which is disposed so as to be moveable in a pressure tight manner in the sleeve-shaped housing element (99; 99'), of which one of these serves as the setpoint value input element, which by means of a controllable electro-motor (131) is driveable in alternative directions for carrying out incremental displacements with respect to the other, which serves as actual position feedback element, which is force-form locking movably connected with the piston (16, 16') of the main control valve (11, 11') and thereby is controllable for carrying out servo-control movements synonymous with the displacement of the setpoint value input element, and c) the servo control valve (14; 14') is provided with a valve spring arrangement (118, 119; 151), which in a non-controlled state of the setpoint input motor (131) adjusts the setpoint input element upon the setpoint input position associated with the operationally neutral central position of the main control valve (11; 11').

2. Control valve arrangement according to claim 1, wherein the main control valve (11) and the servo control valve (14) are constructed as linear slide valves, arranged with their central longitudinal axis (18, 68) running parallel, wherein a return signal element (99) of the servo control valve (14) is connected or coupled axially fixed against sliding with the piston (16) of the main control valve (11) and the setpoint input element (66) of the servo control valve (14) is displaceable axially back and forth by means of an electrical linear drive.

3. Control valve arrangement according to claim 1, wherein the main control valve (11') is constructed as linear slide valve and the servo control valve (14') as rotating slide valve, wherein the actual position feedback element (99') is moveably coupled with the main control valve piston (16') via a coupling arrangement (143, 144), which convert the linear displacements of the piston (16') of the main control valve (11') into azimuthal displacements of the actual position feedback element of the servo control valve (14'), and of which the setpoint value input element (66') is connected fixed against rotation with the drive shaft (146) of the electric setpoint input motor (131).

4. Control valve arrangement according to claim 3, wherein the servo control valve (14') with respect to the central longitudinal axis (18) of the main control valve (11') is so mounted to runs at a right angle with its central longitudinal axis (68) to that of the main control valve (11'), that as actual position feedback element the sleeve-shaped housing element (99') of the servo control valve (14') is utilized, with which a coupling element (143) is connected fixed against rotation, which via form fitting engagement with a take-along element (144) of the main control valve piston (16') converts the axial displacement thereof into azimuthal servo movement of the feedback element (99').

5. Control valve arrangement according to claim 4, wherein the take-along element of the main control valve piston (16') is formed as a ring notch (144) of the same, that the coupling element (143) extends thereinto with a right angular to the central axis (18) of the piston (16') and parallel to the central longitudinal axis (68) of the servo control valve (14') extending, tab-shaped end segment of the take along element (144), and that the arrangement of the notch (144) on the piston (16') of the main control valve (11') and that of the coupling element (143) on the return signal element (99') of the servo control valve (14') thereupon are determined based upon each other, so that in the functional neutral center position of the main control valve (14') the longitudinal axis of the tab like coupling element-segment (143) and the central longitudinal axis (68') of the servo control valve (14') defined planes run right angularly to the central longitudinal axis (18) of the main control valve (11').

6. Control valve arrangement according to claim 5, wherein said engagement end of the coupling element (143) which engages between the notch side walls of the ring notch (144) is constructed as a ball head (177), of which the cross-section is greater than that of the tab shaped end segment, and is approximately the same or at most identical to the thinness separation of the notch wall of the ring notch (144) of the main control valve piston (16') measured in axial direction.

7. Control valve arrangement according to claim 5, wherein a tensioning device (181) is provided, which produces a permanent effective torque between the sleeve-shaped housing element (99') and the piston (66') of the servo control valve (14'), which urges the coupling element (143) in force locking engagement with the one notch wall of the ring notch (144) of the piston (16') of the main control valve (11') and of which the value is smaller than the arrest moment of the setpoint input-motor (131) and is also smaller than the return urging moment exercised in the engaged pressure supply through the piston (16') upon the piston side housing element (99') of the servo control valve (14').

8. Control valve arrangement according to claim 7, wherein the total value Ø of the azimuthal deflection of the piston (66') of the servo control valve (14') with respect to the sleeve-shaped housing element (99') is less than 180°, thereby characterized, that the azimuthal displacement area Ø through impact effect of an with the piston (66') fixed connected radial rod or shaft with the aximuthal bordering or limiting of an itself in circumference direction extending long hole of the sleeve-shaped housing element (99') or a face side associated, edge open, sector shaped recess of the same is bordered, and that the tensioning device includes an under pull tension standing tensioning spring secured on the one hand in the free end of the shaft and on the other hand in the sleeve-shaped housing element (99'), which is received by an open ridge of the sleeve-shaped housing element (99') having a circumference area complimentary to the displacement range or area Ø.

9. Control valve arrangement according to claim 3, wherein in the not-driven condition the setpoint input motor (131) the setpoint value input element (66, 66') therein with the center position of the main control valve piston (16, 16') associated setpoint value input position urging spring arrangement is an azimuthally pretensioned helical coil spring, of which the coil axis coaxially circumscribe the central axis (68) of the servo control valve (14, 14'), as a shank spring (151), which has two radial or approximately radial engaging free shank ends, between which a fixedly with the connection block (114') of the servo control valve (14') are connected abutment tab and a fixed against rotation with the setpoint value input element abutment tab (156).

10. Control valve arrangement according to claim 9, wherein at least one of the windings (158) of the shank spring (151) which coaxially circumscribes the central axis of the servo control valve (14') is provided with a bulge, which form fittingly engages an abutment plug fixedly connected with the connection block (114') of the servo control valve (14) and extending parallel to the central longitudinal axis (68) thereof.

11. Control valve arrangement according to claim 1, wherein in the not-driven condition of the setpoint input motor (131) the setpoint input element (66; 66') therein with the center position (0) of the main control valve piston (16; 16') associated setpoint input position urging valve spring arrangement includes two pretensioned press springs (118, 119), which biases in opposite directions the setpoint value input element of the servo control valve.

12. Control valve arrangement according to claim 11, wherein the pretensioning of the press springs (118, 119) is adjustable.

13. Control valve arrangement according to claim 11, wherein the tensioning stroke of the valve springs (118, 119) is limitable by restraining the springs to that desired value, in which the central position (0) of the main control valve piston (16; 16') the associated position of the setpoint value element is achieved.

14. Control valve arrangement as in claim 1, wherein said controllable electro-motor (131) is a step motor.

* * * * *